US005165178A

United States Patent [19]

Seely

[11] Patent Number: 5,165,178

[45] Date of Patent: Nov. 24, 1992

[54] ARCHERY BOW SIGHT APPARATUS

[76] Inventor: Ronald D. Seely, P.O. Box 1414, Lacombe Alberta, Canada, TOCISO

[21] Appl. No.: 835,314

[22] Filed: Feb. 14, 1992

[51] Int. Cl.[5] ..... F41G 1/467

[52] U.S. Cl. ..... 33/265; 124/87

[58] Field of Search ..... 124/87; 33/265

[56] References Cited

U.S. PATENT DOCUMENTS 3,136,063 6/1964 Stebbins ..... 33/265

4,999,919 3/1991 Sparkman ..... 33/265

*Primary Examiner*—Harry N. Haroian

*Attorney, Agent, or Firm*—Leon Gilden

[57] ABSTRACT

A sight apparatus includes a mounting plate, with the mounting plate including a plurality of U-shaped loops mounted thereto, with the second of the U-shaped loops including spaced parallel grooves coextensive therewith to secure crossed spring lines that are repositionable along their ends relative to the grooves for adjustment of the lines relative to a sighting procedure.

3 Claims, 4 Drawing Sheets

ARCHERY BOW SIGHT APPARATUS

BACKGROUND OF THE INVENTION

1. Field of the Invention

The field of invention relates to archery apparatus, and more particularly pertains to a new and improved archery bow sight apparatus wherein the same is arranged for incremental adjustment of vertical and horizontal cross-hair portions of a target sight structure.

2. Description of the Prior Art

Archery bow construction in the prior art is of a varied and complex nature in contemporary archery. Such apparatus is exemplified in U.S. Pat. Nos. 4,928,394; 4,884,347; 4,733,474; and 4,846,141 utilizing various complex and interrelated structures for the positioning of a sighting arrangement relative to an archery bow.

Accordingly, it may be appreciated that there continues to be a need for a new and improved archery bow sight apparatus as set forth by the instant invention which addresses both the problems of ease of use as well as effectiveness in construction overcoming disadvantages of the prior art relative to the simplification of structure relative to a second structure and in this respect, the present invention substantially fulfills this need.

SUMMARY OF THE INVENTION

In view of the foregoing disadvantages inherent in the known types of archery sighting apparatus now present in the prior art, the present invention provides an archery bow sight apparatus wherein the same is arranged for the incremental sighting adjustment of the cross-hairs of a bow sighting arrangement. As such, the general purpose of the present invention, which will be described subsequently in greater detail, is to provide a new and improved archery bow sight apparatus which has all the advantages of the prior art archery bow sight apparatus and none of the disadvantages.

To attain this, the present invention provides a sight apparatus including a mounting plate, with the mounting plate including a plurality of U-shaped loops mounted thereto, with the second of the U-shaped loops including spaced parallel grooves coextensive therewith to secure crossed spring lines that are repositionable along their ends relative to the grooves for adjustment of the lines relative to a sighting procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved archery bow sight apparatus which has all the advantages of the prior art archery bow sight apparatus and none of the disadvantages.

It is another object of the present invention to provide a new and improved archery bow sight apparatus which may be easily and efficiently manufactured and marketed.

It is a further object of the present invention to provide a new and improved archery bow sight apparatus which is of a durable and reliable construction.

An even further object of the present invention is to provide a new and improved archery bow sight apparatus which is susceptible of a low cost of manufacture with regard to both materials and labor, and which accordingly is then susceptible of low prices of sale to the consuming public, thereby making such archery bow sight apparatus economically available to the buying public.

Still yet another object of the present invention is to provide a new and improved archery bow sight apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
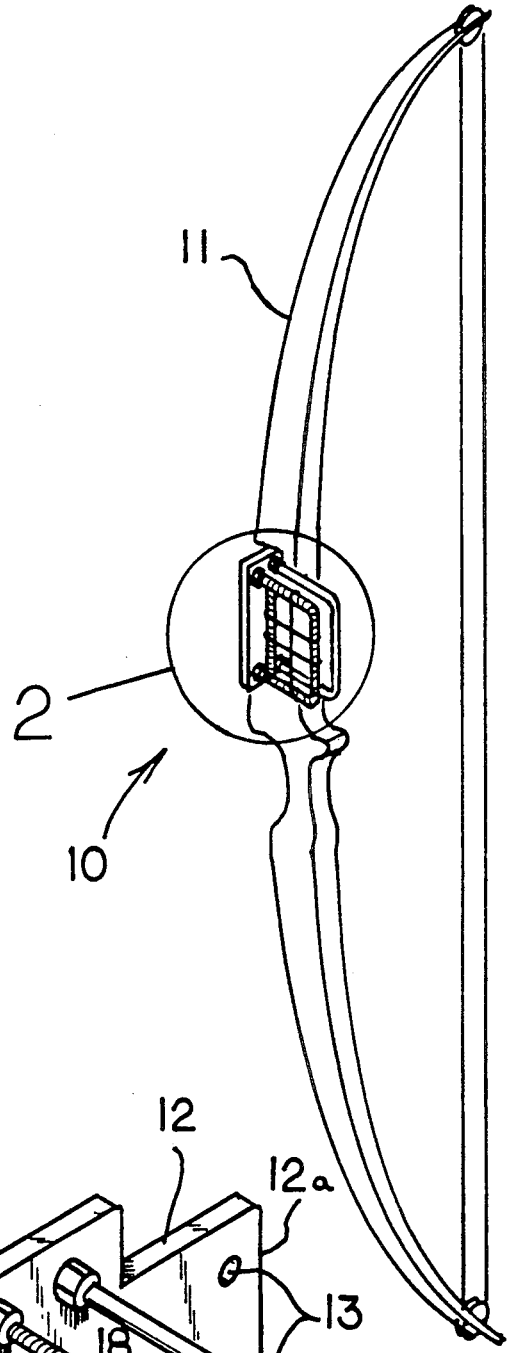
FIG. 1 is an isometric illustration of the instant invention mounted to an associated archery bow.
Figure 2:
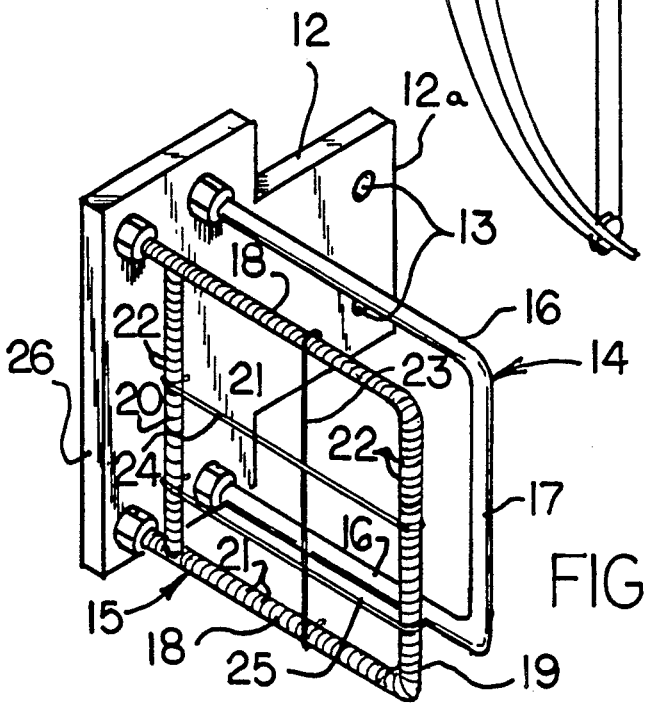
FIG. 2 is an isometric illustration of the archery bow sight apparatus of the instant invention.
Figure 3:
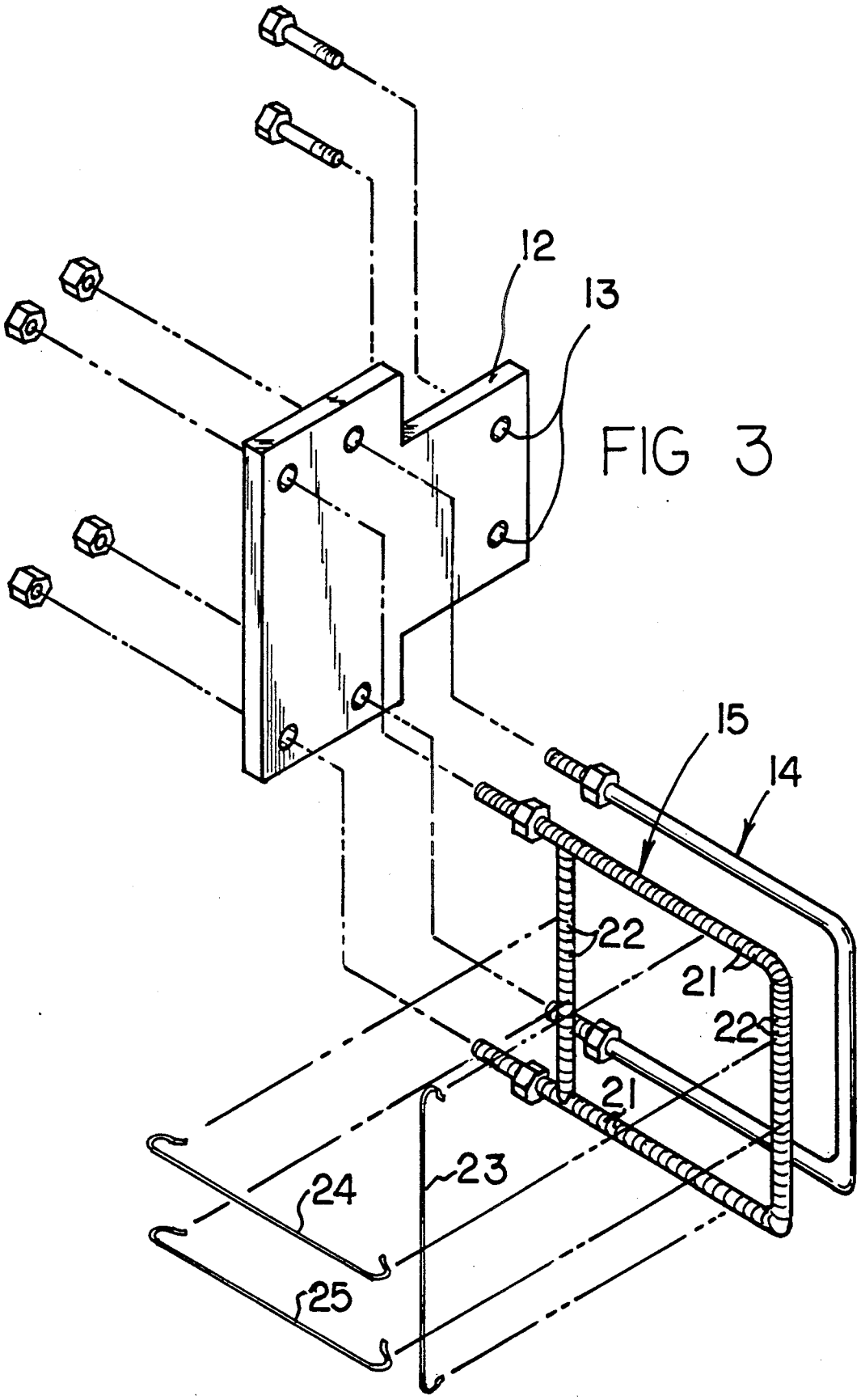
FIG. 3 is an isometric exploded illustration of the instant invention.

With reference now to the drawings, and in particular to FIGS. 1 to 7 thereof, a new and improved archery bow sight apparatus embodying the principles and concepts of the present invention and generally designated by the reference numerals 10, 10*a*, and 10*b* will be described.

More specifically, the archery bow sight apparatus 10 of the instant invention essentially comprises the organization mounted to an archery bow 11, as illustrated in FIG. 1. The apparatus includes a mounting plate 12 formed with a plurality of mounting plate fastener receiving bores 13 directed through the mounting plate adjacent a mounting plate rear end 12*a*. Orthogonally directed through the mounting plate is a respective first U-shaped loop 14 arranged in a parallel and coextensive relationship, with a second U-shaped loop 15. The first and second U-shaped loops 14 and 15 are orthogonally mounted to the mounting plate 12, with the first loop 14 including first loop legs 16 arranged in a parallel coextensive relationship spaced apart a predetermined spacing. A first loop connecting leg 17 joins outer terminal ends of the legs 16, with the connecting leg 17 arranged in a parallel relationship relative to the mounting plate 12. The second loop 15 includes second loop legs 18 that are parallel and coextensive and spaced apart the predetermined spacing, with a second loop first connecting leg 19 mounted to outer distal ends of the second loop connecting legs 18, and a second loop second connecting leg 20 arranged in a parallel relationship relative to the first connecting legs positioned adjacent to and parallel the mounting plate 12. The second loop legs 18 each include parallel first grooves 21 that are coextensive with the legs 18 and second groove 22 that are parallel relative to one another and are coextensive with the first and second connecting legs 19 and 20. Secured to the first grooves 21 of the second loop first legs 19 is a single first vertical spring line 23 that is biased to spaced grooves 21 of the first legs to orthogonally intersect the first legs. A second and third horizontal spring line 24 and 25 are orthogonally directed between the first and second connecting legs 19 and 20 and secured to the second grooves 22 thereof orthogonally oriented relative to the first spring line 23 to provide for a cross-hair structure that is easily displaceable relative to the second loop in a manner permitting ease of manipulation of the first, second, and third spring lines. The spring lines are formed of a metallic spring material, with loops at each end of the spring lines for securement to grooves of spaced legs of the second loop, as illustrated in the FIG. 2.

Figure 4:
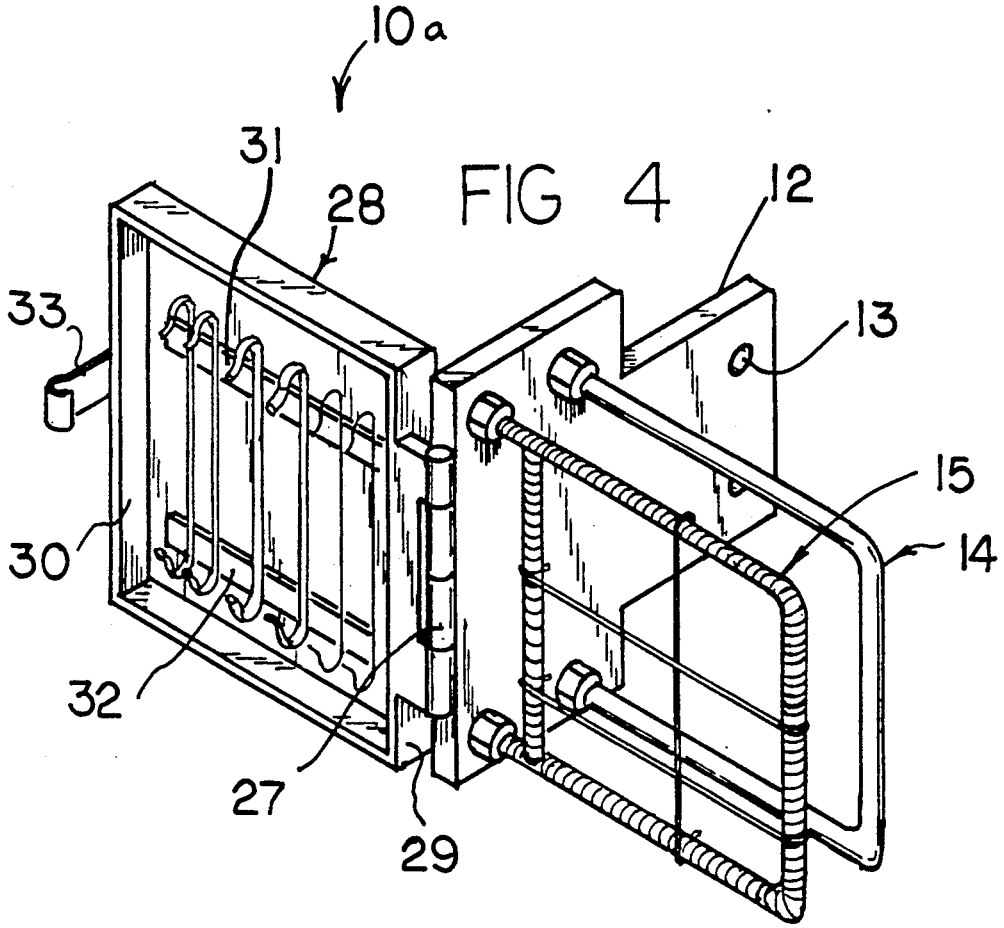
FIG. 4 is an isometric illustration of a modification of the invention.
Figure 5:
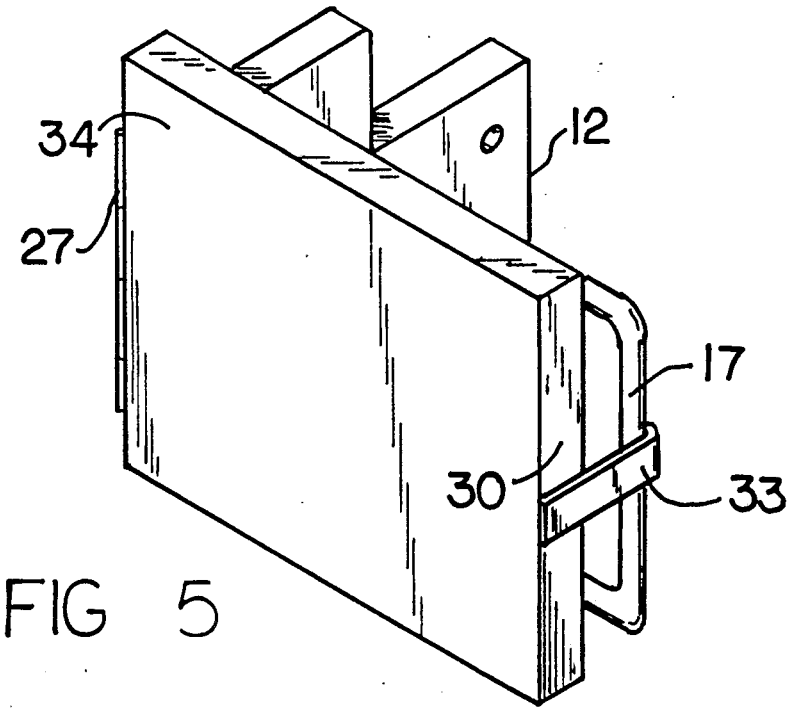
FIG. 5 is an isometric illustration of the modified structure in a folded second configuration.

The mounting plate forward edge 26 in the modified apparatus illustrated in FIG. 4 includes a spring hinge 27 secured thereto and to a container first end wall 29 of a container 28. The container 28 includes a second end wall 30 spaced from the container first end wall 29. In a bottom, as illustrated in the FIGS. 4 and 5, a second wall clip 33 is secured to the second end wall 30 for securement to the first loop connecting leg 17 when the container is in a second orientation parallel to and receiving the second loop therewithin. The container includes a container floor 34, including a plurality of parallel magnetic strips including a first and second magnetic strip 31 and 32 respectively. The first and second magnetic strips 31 and 32 include thereon replacement connecting lines of various widths for use at various distances and in different shooting environments.

Figure 6:
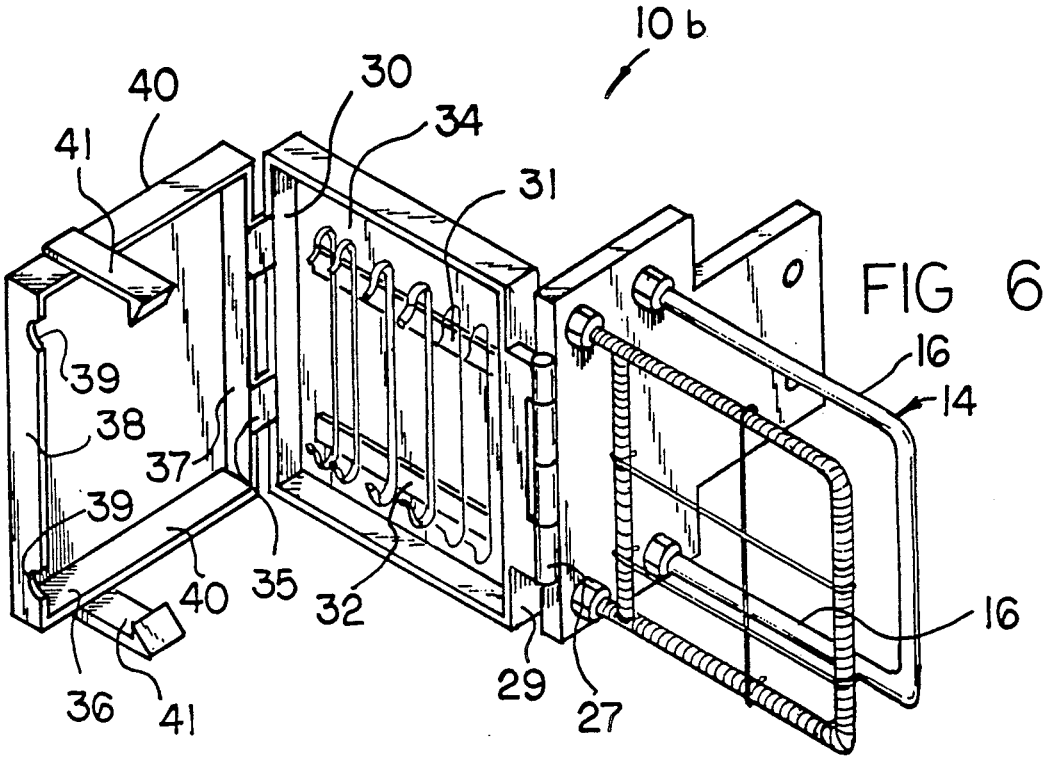
FIG. 6 is an isometric illustration of a yet further modification of the invention.
Figure 7:
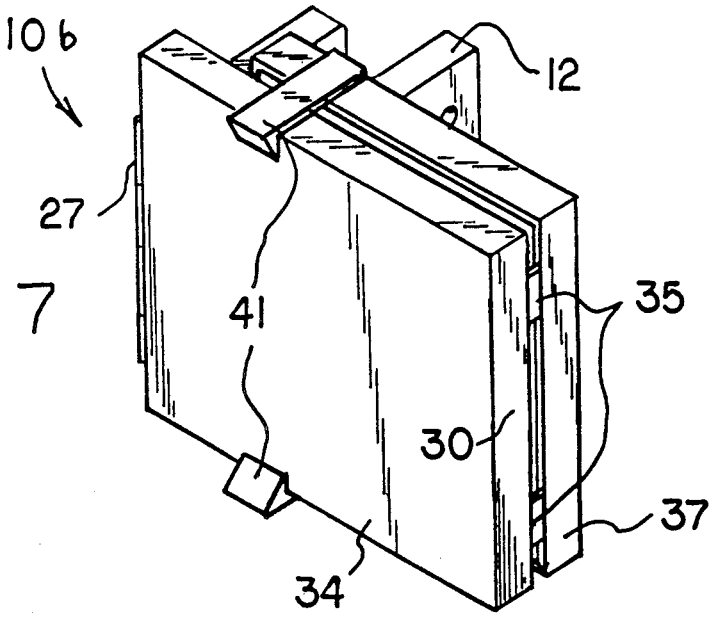
FIG. 7 is an isometric illustration of the further modified aspect of the invention in a folded second position.

The apparatus 10*b*, as illustrated in FIGS. 6 and 7, illustrates the container 28 including a second hinge 35 mounted to the container second end wall 30. The second hinge structure 35 hingedly mounts a second container 36 thereto, with the second container including a second container first end wall 37 spaced from a second container second end wall 38. The second container second end wall 38 includes a plurality of second end wall recesses 39 spaced apart the predetermined spacing of the first loop leg 16 when the first container is in a second position receiving the second loop therewithin, and the second container receives a first loop therewithin, with the use of second container side wall clasp members 41 mounted to the second container side walls 40 securable to the first container floor 34 when the second container receives the first loop 14 therewithin.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An archery bow sight apparatus for mounting to an archery bow, wherein the apparatus comprises, a mounting plate, the mounting plate including a mounting plate rear end and a mounting plate forward end, and a first U-shaped loop orthogonally mounted to the mounting plate positioned between the forward end and the rear end, and a second U-shaped loop positioned adjacent to in a parallel and coextensive relationship relative to the first U-shaped loop orthogonally mounted to the mounting plate between the first U-shaped loop and the mounting plate second end, the first U-shaped loop affording protection to the second U-shaped loop, with the first U-shaped loop including spaced parallel first loop legs spaced apart a predetermined spacing, and a first loop connecting leg orthogonally and integrally mounted to the first loop legs at outer distal ends of the first loop legs, with the first loop connecting leg arranged parallel relative to the mounting plate, and the second U-shaped loop including second loop parallel legs, and a second loop first connecting leg and a second loop second connecting leg, with the second loop first connecting leg and the second loop second connecting leg orthogonally oriented to the second loop legs, with the second loop first connecting leg and the second loop second connecting leg arranged in a parallel coextensive relationship relative to one another, and a first vertical spring line formed of a spring material secured between the second loop legs, and at least one horizontal spring line secured between the second loop first connecting leg and the second loop second connecting leg, and the second loop legs each include spaced parallel grooves coextensive with the second loop legs to receive opposed distal ends of the first spring line, and the second loop first connecting leg and the second loop second connecting leg each including parallel second grooves coextensive with the first connecting leg and the second connecting leg to receive opposed distal ends of the second spring line, wherein the first spring line and the second spring line each are formed of a metallic spring material and orthogonally oriented relative to one another and intersecting within the second U-shaped loop, and a spring hinge is mounted to the mounting plate forward end and a first container is mounted to the spring hinge, the first container including a first container first end wall spaced from a first container second end wall, the first container first end wall secured to the spring hinge, and the first container including a first container floor, and a first magnetic strip and a second magnetic strip secured to the first container floor securing a plurality of spring lines therebetween.

2. An apparatus as set forth in claim 1 including a second hinge mounted to the first container second end wall, the second hinge including a second container mounted to the second hinge, with the second container including a second container first end wall secured to the second hinge, with the second container first end wall spaced from a second container second end wall, with the second container second end wall including a plurality of second end wall recesses spaced apart the predetermined spacing to receive the first U-shaped loop first loop legs therewithin when the first container is pivoted relative to the mounting plate to receive the second loop therewithin, and the second container is pivoted in surrounding relationship relative to the first U-shaped loop to receive the first U-shaped loop therewithin.

3. An apparatus as set forth in claim 2 wherein the second container includes second container side walls, and each second container side wall includes a clasp member, each clasp member is arranged for securement to the first container floor when the second container receives the first U-shaped loop therewithin.

* * * * *